United States Patent [19]

Yamaguchi et al.

[11] 4,362,040

[45] Dec. 7, 1982

[54] METHOD AND APPARATUS FOR THE CONTROLLED COOLING OF HOT ROLLED STEEL RODS

[75] Inventors: Yoshihiro Yamaguchi; Kouro Takatsuka, both of Kobe; Shohei Murakami, Akashi; Rikuo Ogawa, Kobe; Yoshiro Yamada, Akashi; Tadamasa Yokoyama, Kobe; Shoji Akita, Nishinomiya, all of Japan

[73] Assignee: Kobe Steel, Limited, Kobe, Japan

[21] Appl. No.: 134,300

[22] Filed: Mar. 26, 1980

[30] Foreign Application Priority Data

Mar. 29, 1979 [JP] Japan ..... 54-38049

[51] Int. Cl.[3] ..... B21B 43/10

[52] U.S. Cl. ..... 72/201; 148/156; 266/106

[58] Field of Search ..... 72/201, 202, 200, 39, 72/40; 266/106; 148/143, 156, 157; 140/2

[56] References Cited

U.S. PATENT DOCUMENTS

| | | | |
|---|---|---|---|
| 3,399,702 | 9/1968 | Kenmore | 72/39 |
| 3,500,877 | 3/1970 | Lingen | 140/2 |
| 3,940,961 | 3/1976 | Gilvar | 266/106 |
| 3,940,967 | 3/1976 | Vitelli | 72/201 |
| 4,023,392 | 5/1977 | Fujita | 266/106 |
| 4,044,938 | 8/1977 | Heiss | 140/2 |

FOREIGN PATENT DOCUMENTS

| | | | |
|---|---|---|---|
| 42-15463 | 8/1967 | Japan . | |
| 42-18894 | 9/1967 | Japan . | |
| 43-25810 | 11/1968 | Japan . | |
| 44-7469 | 4/1969 | Japan . | |
| 44-18051 | 8/1969 | Japan | 266/106 |
| 45-8536 | 3/1970 | Japan . | |
| 48-31446 | 9/1973 | Japan . | |

*Primary Examiner*—Gene Crosby

*Attorney, Agent, or Firm*—Oblon, Fisher, Spivak, McClelland & Maier

[57] ABSTRACT

A method and apparatus for the controlled cooling of a hot rolled steel rod. A hot rolled steel rod issued from a final stand of mill train is rapidly cooled, and then formed into a coil. The coiled rod is transported in a generally horizontal direction with its loops held at an angle of 30° to 60° relative to the direction of transportation and with a pitch of at least 2d/sin α where d is a diameter of the rod and α is the above-mentioned angle. A cooling medium, e.g. air, is forcibly applied to the coiled rod upwardly from below the coiled rod to cool the coiled rod uniformly at such a cooling rate as to achieve a phase transformation to obtain a structure consisting essentially of fine pearlite. The apparatus includes a cooling device for the rapid cooling, a laying head for the coil forming, a conveyor for transporting the coiled rod while supporting its loops at the angle and pitch, a coolant supply, and a mechanism for collecting the treated rod.

7 Claims, 19 Drawing Figures

METHOD AND APPARATUS FOR THE CONTROLLED COOLING OF HOT ROLLED STEEL RODS

BACKGROUND OF THE INVENTION

1. Field of the Invention

The present invention relates to a method and apparatus for controlled cooling of hot rolled steel rods, and more particularly to controlled cooling treatment to ensure uniform cooling of a hot rolled steel rod on a cooling device following the finishing mill train, thereby minimizing the fluctuations in the tensile strength of the treated rod, improving the tensile strength and preventing deformations of the coiled rod during the cooling operation.

2. Description of the Prior Art

The controlled cooling of a hot rolled steel rod issued from the final stand of mill train normally includes transporting the rod in a form of a coil by a conveyor and applying a cooling medium, e.g. air, thereto. There have been several proposals for methods and apparatus for the controlled cooling, some of which are used in practice. For example, there may be mentioned (i) a method in which a coiled rod issued from a laying head is transported by a conveyer with the loops of the coiled rods held vertically and subjected to natural cooling during transportation (Japanese Patent Publication No. 7469 of 1969), (ii) a method which includes letting loops of the coiled rod fall down vertically whereby controlled cooling is accomplished during the fall of the loops (Japanese Patent Publications Nos. 18894 of 1967, 25810 of 1968, and 8536 of 1970), (iii) a so-called Stelmore line in which loops of the coiled rod are laid on a belt conveyor in a non-concentrically overlapping manner and are subjected to controlled cooling during transportation with an air blast (Japanese Patent Publication No. 15463 of 1967), (iv) a method in which each loop of the coiled rod is supported by a supporter within the loop and controlled cooling is accomplished during transportation (Japanese Patent Publication No. 31446 of 1973).

However, the above method (i) has drawbacks in that it is difficult to hold each loop in the vertical position, the supporter is adapted to impart a supporting force to the loop inwardly from outside of the loop at the opposing horizontal positions and is therefore likely to cause deformations of the loops, which then adversely affect the appearance of collected rod, and the loops are susceptible to creep deformation due to their own weight during the controlled cooling, which deformation also adversely affects the appearance of collected rod, and accordingly this method is not practically in use. The method (ii) can be operated in various manners e.g. the controlled cooling is performed while loops of the coiled rod are supported by supporting rods or pins, or the controlled cooling is accomplished by letting the coiled rod fall into boiled water. However, this method has shortcomings in that the operation is rather cumbersome, the loops tend to overlap each other and the cooling effectiveness of the cooling medium is not constant and uniform cooling can not therefore be ensured. In the above method (iii), the cooling rate at the overlapping portions of the non-concentric loops differs substantially from the cooling rate at other portions of the loops and uniform cooling along the entire loop cannot be attained. For example, fluctuations in the tensile strength of a loop obtained by a lead patenting of a hot rolled steel rod of JIS Standard SWRH62A having a diameter of 5.5 mm$\phi$ are within about 2 kg/mm$^2$, whereas the direct patenting by means of the method (iii) gives fluctuations in the tensile strength as great as about 8 kg/mm$^2$. The method (iv) requires an extremely large apparatus and is not practically used.

SUMMARY OF THE INVENTION

Accordingly, it is an object of the present invention to provide a method for the controlled cooling of a hot rolled steel rod whereby uniform cooling of a coiled rod is ensured to thereby obtain a rod with uniform properties and improved tensile strength.

It is another object of the invention to provide a method for the controlled cooling of a hot steel rod whereby uniform cooling can be accomplished without causing deformations of the loops of the coiled rod.

A further object of the present invention is to provide an apparatus specifically adapted to carry out the method of the invention.

Thus, the present invention provides a method for the controlled cooling of a hot rolled steel rod, which includes forming a hot rolled steel rod into a coil, transporting the coiled rod in a generally horizontal direction while supporting its loops at a loop plane angle of 30° to 60° relative to the direction of transportation and with a pitch of at least $2d/\sin\alpha$ in the direction of transportation, where d is a diameter of the coiled rod and $\alpha$ is the loop plane angle, and applying a cooling medium, e.g. air, to the coiled rod upwardly from below the coiled rod during the transportation to cool the coiled rod uniformly at such a cooling rate as to achieve a phase transformation to obtain a structure consisting essentially of fine pearlite.

The present invention also provides an apparatus for the controlled cooling of a hot rolled steel rod, which includes a cooling device for rapidly cooling a hot rolled steel rod issued from a final stand of mill train, a laying head for forming the rapidly cooled rod into a coil, a conveyor mechanism for transporting the coiled rod in a generally horizontal direction while supporting its loops at a loop plane angle of 30° to 60° relative to the direction of transportation and with a pitch of at least $2d/\sin\alpha$ in the direction of transportation, where d is a diameter of the coiled rod and $\alpha$ is the loop plane angle. There is also provided a control means to synchronize the transportation speed of the conveyor with the speed at which the coiled rod is issued from the laying head. The apparatus further includes a coolant supply to forcibly apply a fluid cooling medium to the coiled rod upwardly from below the coiled rod during transportation to cool the coiled rod uniformly at such a cooling rate as to achieve a phase transformation to obtain a structure consisting essentially of fine pearlite, and a mechanism for collecting the treated coiled rod.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1A:
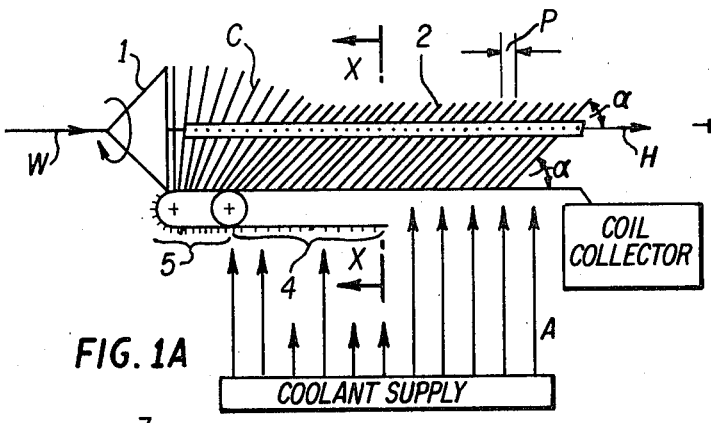
FIG. 1(A) is a diagramatic side view of an apparatus for the controlled cooling of a hot rolled steel rod according to the present invention.

Referring to FIGS. 1(A), (B) and (C), hot rolled steel rod W issued from the final stand of mill train is formed into a coil C by a laying head 1 which rotates about an axis extending in the direction of transportation of the coiled rod. The coiled rod C is then placed on a carriage conveyor 4 with its loops held by e.g. supporters 3 of a support conveyor 2 at a predetermined loop plane angle $\alpha$, i.e. an angle between the plane of a loop and the direction H of transportation of the coiled rod, and with a predetermined pitch P, i.e. spacing between adjacent loops, and it is transported in a generally horizontal direction to the right as shown in FIGS. 1(A) and (C). A cooling medium A, e.g. air, is supplied from below the conveyors upwardly to effect the controlled cooling of the coiled rod. Thereafter, the coiled rod is collected by a coil collecting means.

The effectiveness of the controlled cooling during the transportation of the coiled rod varies depending upon the pitch P and a supply angle of the cooling medium A relative to the loops of the coiled rod.

Figure 2:
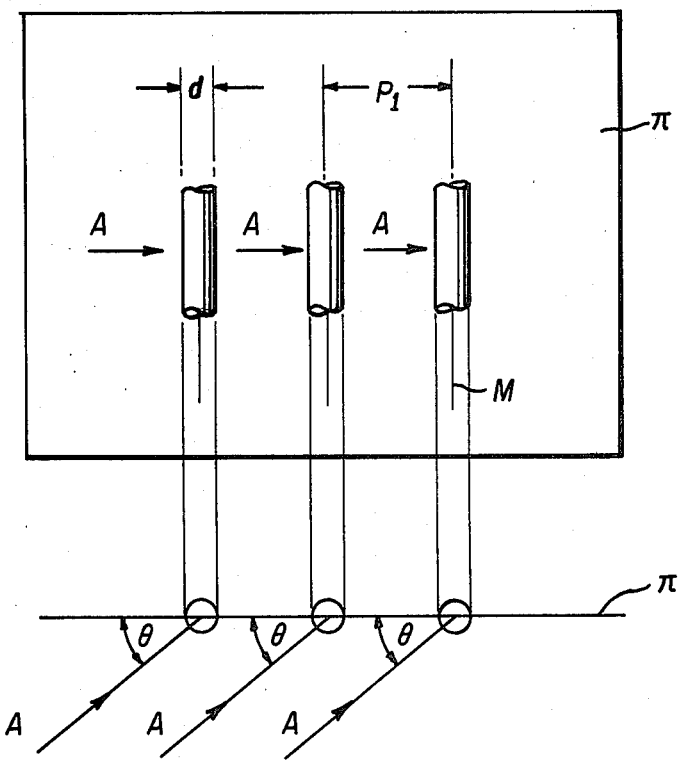
FIGS. 2, 4 and 7(A), (B) and (C) illustrate supply angles of the cooling medium relative to the coiled rod.

FIG. 2 illustrates the manner in which experiments were conducted with use of straight rods of a high carbon steel (carbon content being 0.72%) having a diameter of 5.5 mm$\phi$ to determine the influences of the pitch $P_1$ over the effectiveness of the controlled cooling treatment i.e. over the mechanical property (e.g. tensile strength) of the treated rod. The austenite grain size of the sample rod was grain size number 6.5. The cooling medium, i.e. air, at a temperature of 30° C. was supplied at a velocity of 40 m/sec.

Referring to FIG. 2, $\theta$ is a supply angle of the cooling medium A against the imaginary surface $\pi$ including all the center lines M of the rods. According to the present invention, the loops of the coiled rod are inclined relative to the direction of transportation of the coiled rod so that the corresponding imaginary surface $\pi$ of the loops assumes a shape of an elliptic cylinder and accordingly the corresponding supply angle $\theta$ of the cooling medium A against the imaginary elliptic cylinder is 90° at the top and bottom of each loop and 0° at both sides of each loop.

Figure 3A:
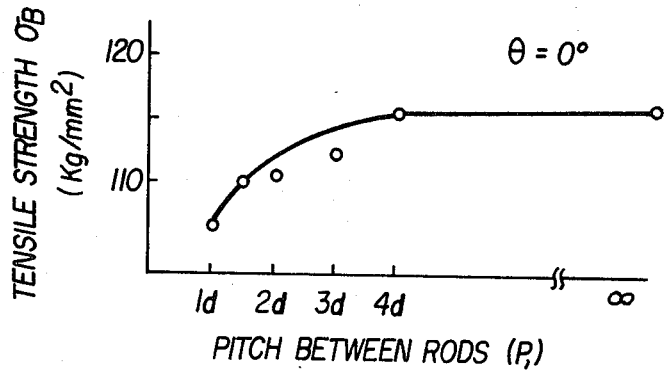
FIGS. 3(A), (B) and (C) are graphs illustrating influences of the pitch between adjacent loops of the coiled rod over the mechanical property of the treated rod.

FIGS. 3(A), (B) and (C) show the results of the experiments obtained with angle $\theta$ (as shown in FIG. 2) being 0°, 30° and 90°, respectively. In each Figure the axis of abscissa represents the pitch $P_1$ between the rods, and d is the diameter of the rods. Accordingly, 1d means that adjacent rods are in contact with each other and 2d means that adjacent rods are spaced from each other at a distance of the diameter d of the rods. It is indicated by the Figures that where the pitch $P_1$ is small, no adequate cooling effect is obtained as evidenced by the poor tensile strength of the treated rods, the tensile strength is improved with the increase of the pitch $P_1$ and a stabilized adequate tensile strength is obtained with a pitch $P_1$ of at least 2d, preferably at least 4d. Thus, it is indicated that in order to conduct the controlled cooling effectively, $P_1 \geqq 2d$, preferably $P_1 \geqq 4d$, should be satisfied.

Figure 4:
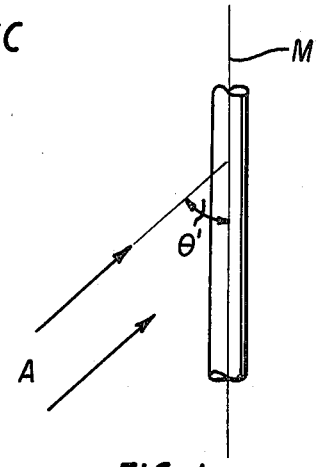

FIG. 4 illustrates the manner in which experiments were conducted with use of a straight rod of a high carbon steel having a diameter of 5.5 mm$\phi$ to determine the influences of the supply angle $\theta'$ of the cooling medium A relative to the center line M of the rod over the mechanical properties of the treated rod. According to the present invention, the loops of the coiled rod are held inclined while the cooling medium is supplied vertically upwardly from below the coiled rod, and accordingly, the angle $\theta'$ is 90° at the top and bottom of each loop and $90° - \alpha$ at both sides of the loop, where $\alpha$ is an angle of the plane of the loop relative to the direction H of transportation of the coiled rod.

The experiments were conducted by supplying the cooling medium, i.e. air, at a temperature of 30° C. at a velocity of 40 m/sec.

Figure 5A:
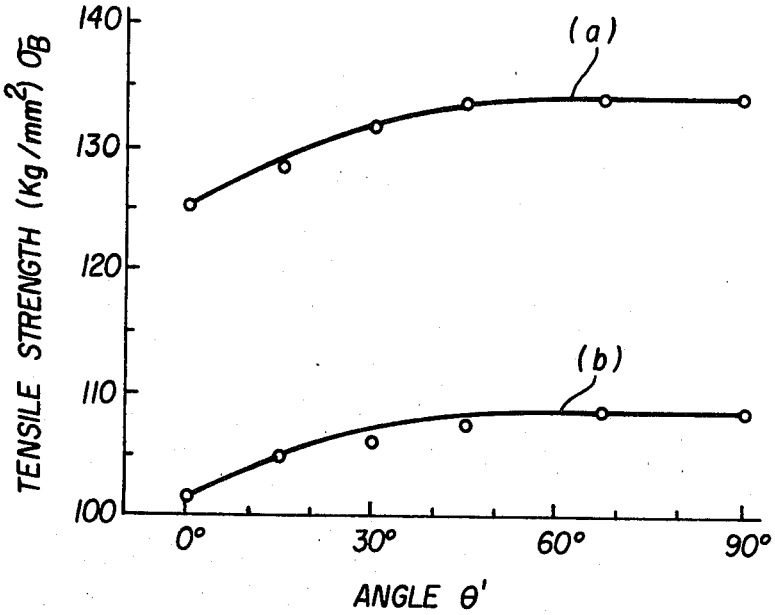
FIGS. 5(A) and (B) are graphs illustrating influences of the angles for supply of the cooling medium over the mechanical property of the treated rod.
Figure 5B:
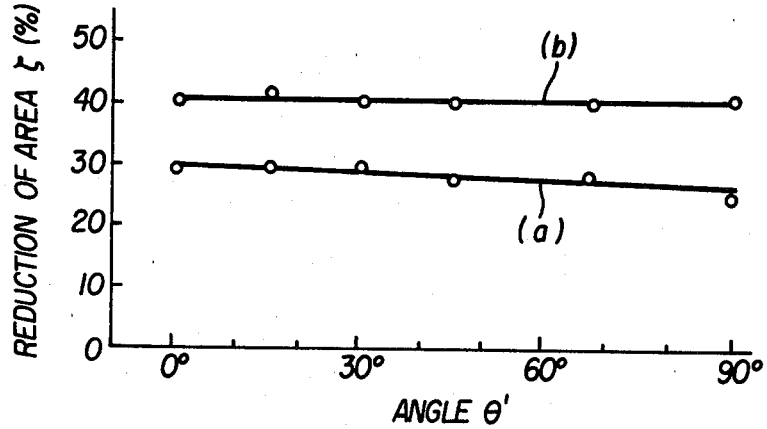

FIGS. 5(A) and (B) show the results of the experiments of FIG. 4. FIG. 5(A) presents the tensile strengths $\sigma_B$ (kg/mm$^2$) of the treated rods, whereas FIG. 5(B) presents the reduction of area $\psi$ (%). In each Figure, the curve (a) represents the results obtained with a steel rod having a carbon content of 0.72% and the curve (b) represents the results obtained with a steel rod having a carbon content of 0.62%. It is shown that while the reduction of area $\psi$ (%) is constant regardless of changes in the angle $\theta'$ (FIG. 5(II)), the tensile strengths $\sigma_B$ are considerably influenced by the angle $\theta'$. Where the angle $\theta'$ is small, no adequate effectiveness of the controlled cooling is obtained and the tensile strength of the treated rod is low, whereas, when the angle $\theta'$ is 30° or more, stabilized high tensile strengths are obtained, showing that an adequate cooling effectiveness is thereby attained.

Figure 6A:
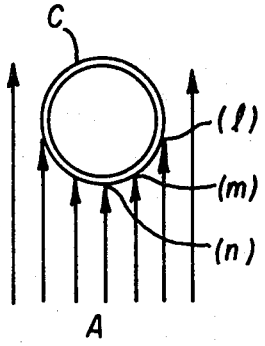
FIGS. 6(A) and (B) illustrate angles at which the cooling medium is in contact with a loop of the coiled rod.

Further, the angle $\theta'$ is also important in connection with the fluctuations in the tensile strengths within a loop. Where the angle $(90° - \alpha)$ of the plane of the loop relative to the supply direction of the cooling medium is 0° or close to 0° (i.e. the loops are held substantially vertically and the cooling medium is supplied vertically (i.e. parallel to the plane of each loop) upwardly from below the coiled rod), the angle $\theta'$ between the supply direction of the cooling medium A and the center line M of the rod is different at different points l, m and n in the range of from 0° (at point l) to 90° (at point n), as shown in FIG. 6(A). It is apparent from the above-mentioned FIG. 5(A) that the difference in the angle $\theta$ largely contributes to the fluctuations in the tensile strengths within a loop.

Figure 6B:
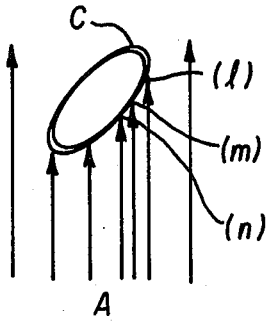

When the angle $(90° - \alpha)$ of the plane of the loop relative to the supply direction of the cooling medium is increased, e.g. up to 45°, the difference in the angle $\theta'$ at points l, m and n is within the range of from 45° (at point n) to 90° (at point l) as shown in FIG. 6(B), and accordingly the fluctuations in the tensile strengths are minimized. Thus, in order to minimize the fluctuations in the tensile strengths and obtain a stabilized high tensile strength, the angle $(90°-\alpha)$ of the plane of the loop relative to the supply direction of the cooling medium should be at least 30°, i.e. the angle $\alpha$ should be at most 60°. However, it is not practical to increase this angle $(90°-\alpha)$ so much (or to reduce the angle $\alpha$ so much) for the reasons discussed hereinbelow.

Figure 3B:
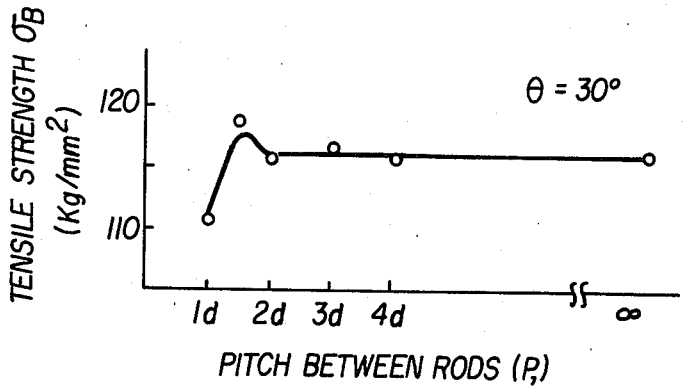
Figure 7A:
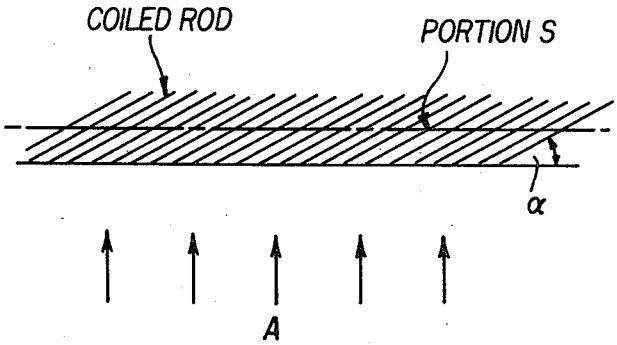
Figure 7B:
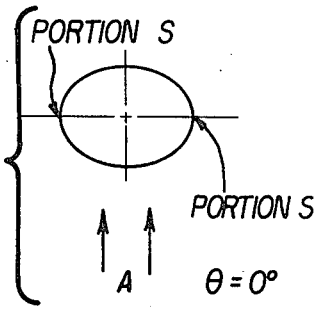
Figure 7C:
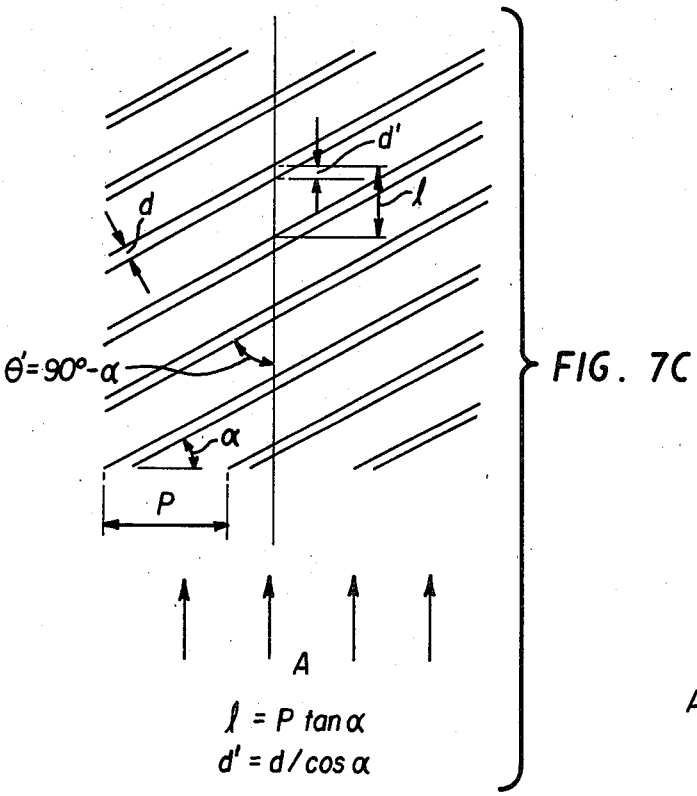

Referring to FIGS. 7(A), (B) and (C), the influences of the distance l between adjacent loops in the supply direction of the cooling medium at both sides of the loops (i.e. at portions S in FIGS. 7(A) and (B), where the angle $\theta$ between the imaginary surface of the loops and the supply direction of the cooling medium is 0° and the angle $\theta'$ between the center line of the rod and the supply direction of the cooling medium is $90°-\alpha$) over the mechanical properties of the coiled rod after the controlled cooling treatment can be judged from the experiments shown in FIGS. 2 and 3. Namely, the pitch $P_1$ and the diameter d in FIG. 2 correspond to the distance l and the imaginary diameter d' in the supply direction of the cooling medium, respectively. Accordingly, the condition of $P_1 \geqq 2d$, preferably $P_1 \geqq 4d$, for the controlled uniform cooling treatment, obtained from the results of FIG. 3 likewise corresponds to a condition of $l \geqq 2d'$, preferably $l \geqq 4d'$, for a controlled uniform cooling treatment at portions S in FIGS. 7(A) and (B). As shown in FIG. 7(C), l is P tan $\alpha$ and d' is d/cos $\alpha$. Accordingly, the above condition may be represented by P tan $\alpha \geqq 2d/\cos\alpha$, preferably P tan $\alpha \geqq 4d/\cos\alpha$, or simply by $P \geqq 2d/\sin\alpha$, preferably $P \geqq 4d/\sin\alpha$.

Figure 3C:
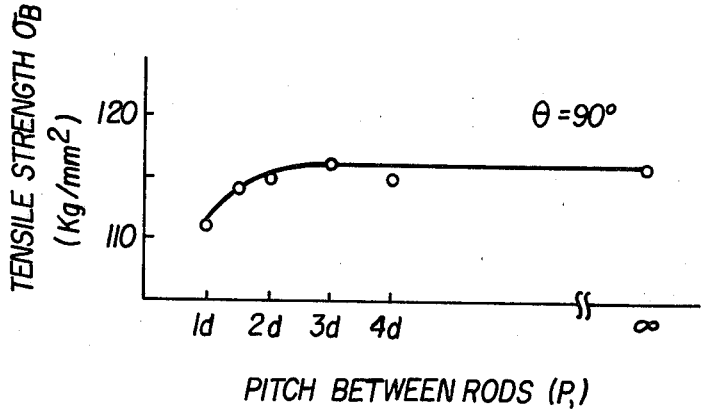

Further, the results shown in FIG. 3(C) are applicable to the top and bottom portions of the loops of FIG. 7(A), i.e. $P_1 = P$, and accordingly the condition of $P_1 \geqq 2d$ for the controlled uniform cooling treatment, is met if the condition of $P \geqq 2d/\sin\alpha$ is satisfied.

Thus, the pitch P of adjacent loops in the direction of transportation of the coiled rod must be at least $2/\sin\alpha$ times, preferably $4/\sin\alpha$ times, the diameter d of the rod.

Now, the relation between the angle $\alpha$ and the necessary length of the cooling bed will be discussed. The necessary length L of the cooling bed is represented by the formula $$L = P \times N \times T \text{ mm} \geqq 2dNT/\sin\alpha$$

where T is time in second required for the controlled cooling treatment, N is the number of loops formed per second, and P is the pitch of the loops in the direction of transportation. Thus, the minimum length $L_{min}$ of the cooling bed is $2dNT/\sin\alpha$.

Figure 8:
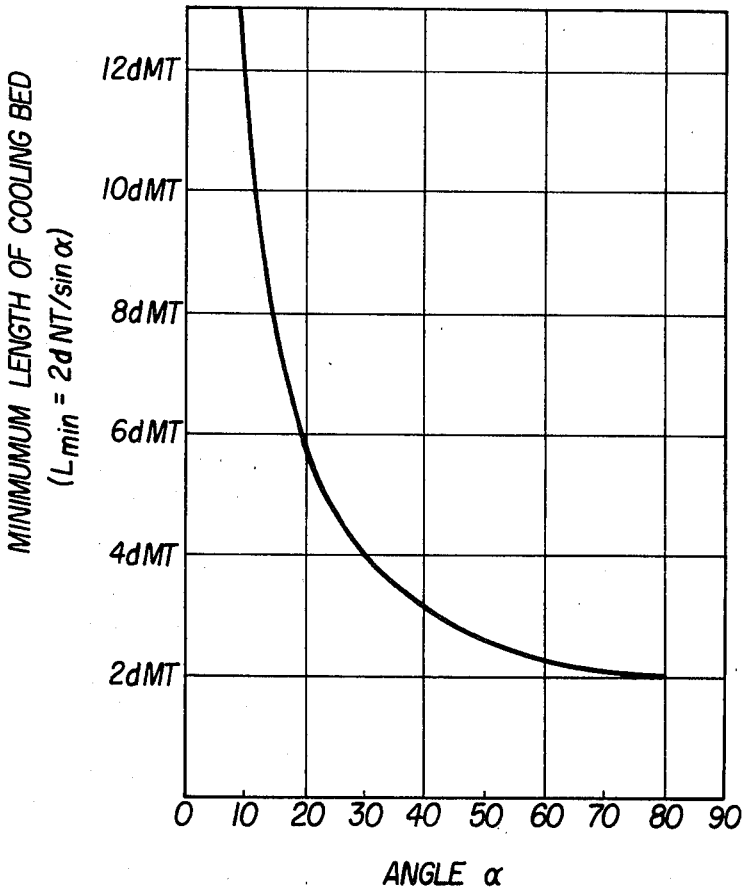
FIG. 8 is a graph illustrating the relationship between an angle $\alpha$ and the length of the cooling bed.

FIG. 8 shows the relationship between the minimum length $L_{min}$ and the angle $\alpha$. It is thereby shown that the required minimum length $L_{min}$ increases sharply as the angle $\alpha$ approaches 20°. Accordingly, it is not practical that $\alpha$ be so small. From a practical point of view, the angle $\alpha$ should be at least 30°.

From the above discussions, it should be noted that the angle $\alpha$ of the plane of each loop relative to the direction of transportation should be within the range of from 30° to 60°. Through the setting of the loop plane angle $\alpha$ coupled with the above mentioned adjustment of the pitch P, it is possible to minimize the fluctuations in the mechanical properties within a loop or coil and to obtain a high tensile strength.

It is advantageous to use a cooling medium having a high heat transfer coefficient (Kcal/m²·h·°C.) to thereby have the tensile strength of the treated rod improved. Blast air as a cooling medium has a maximum heat transfer coefficient of about 300 Kcal/m²·h·°C. for a steel rod temperature of 500° to 600° C., and the heat transfer coefficient can be substantially increased with use of a mist of sprayed water. For instance, a mist having a water density of 20 cc/cm² min. has a heat transfer coefficient of about 1200 Kcal/m²·h·°C. (for a steel rod temperature of 600° C.) and can therefore advantageously be used when it is desired to increase the tensile strength of the coiled rod to a level attained by lead patenting.

The method for controlled cooling of a hot rolled steel rod according to the present invention is advantageously carried out by an apparatus which includes an appropriate cooling device for rapidly cooling a hot rolled steel rod issued from a final stand of mill train, a laying head for forming the rapidly cooled rod into a coil, conveyors adapted to transport the coiled rod under the above-mentioned conditions, i.e. with a predetermined pitch P of loops and at a predetermined angle $\alpha$ of inclination of the loops, a coolant supply to supply a fluid cooling medium to the coiled rod from below the rod, and a mechanical or electric mechanism to synchronize the transportation speed of the conveyors and the rotational speed of the laying head.

Figure 1B:
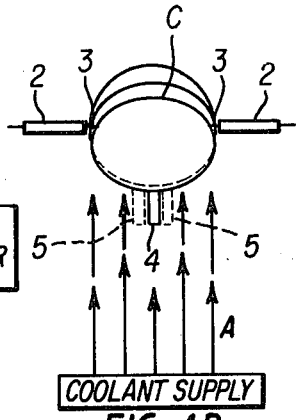
FIG. 1 (B) is a diagramatic cross sectional view taken along the line X—X of FIG. 1(A)
FIG. 1(C) is a diagramatic plan view of the apparatus.
Figure 1C:
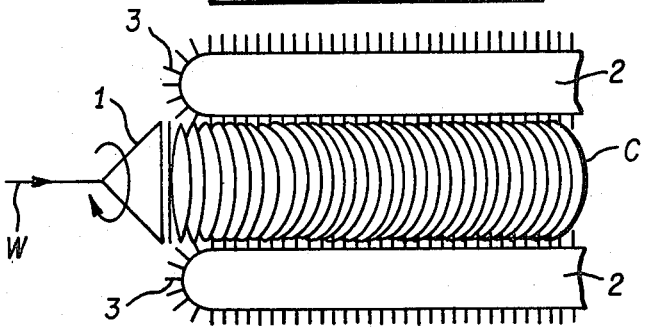

Referring to FIG. 1, a hot rolled steel rod W issued from the final stand of mill train is rapidly cooled by a cooling device and then introduced to a laying head 1. The rod formed into a coil by the laying head 1 is continuously issued onto a carriage conveyor 5 and supported by a support conveyor 2, and then transferred to a succeeding carriage conveyor 4 while being continuously supported by the support conveyor 2. The speed of the conveyors 4, 5 and 2 and the rotational speed of the laying head 1 are synchronized by a proper synchronizing means. The synchronization may be effected mechanically or electrically, e.g. by electrically adjusting the rotational speeds of the driving sprockets for the conveyors 2, 4 and 5 to the rotational speed of the laying head 1.

The coiled rod is placed on the first carriage conveyor 5 with each loop held substantially vertically at first and then inclined gradually towards the direction of transportation so that every loop is inclined at a predetermined loop plane angle $\alpha$ when it is transferred from the first carriage conveyor 5 to the succeeding second carriage conveyor 4. This can be done, e.g. by driving the first carriage conveyor 5 at a speed slower than the succeeding second carriage conveyor 4 while driving the support conveyor 2 at the same speed as the second carriage conveyor 4. The coiled rod is then transported by the conveyors 4 and 2 with its loops held by the supporters 3 of the support conveyor 2 at a predetermined loop plane angle $\alpha$ and with a predetermined pitch P.

As shown in FIG. 1(B), the supporters 3 of the support conveyor 2 are provided to support both sides of the loops at positions slightly higher than the middle of the height of the loops. The supporters should have a sufficient length to be able to accomodate positional fluctuations of the loops in the direction of transportation. However, the length should not be so great as to cause an interference between the supporter with an adjacent loop. Accordingly, the length of the supporters should be determined taking these factors into account. For instance, a length of about 50 mm to about 150 mm is suitable for the loops having a diameter of about 1000 mmϕ to about 1200 mmϕ.

Figure 9A:
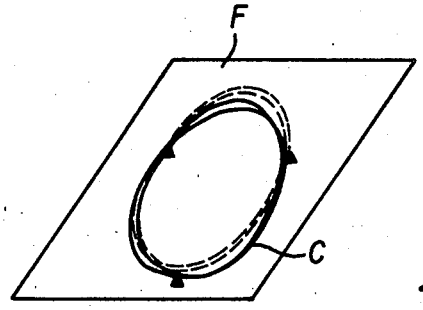
FIGS. 9(A) and (B) illustrate deformations of the loops of the coiled rod.
Figure 9B:
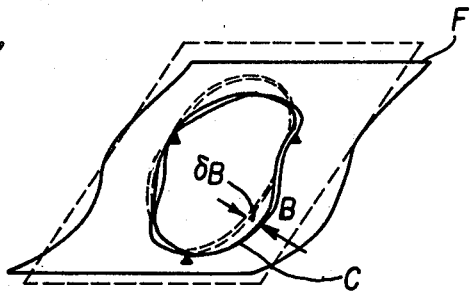
Figure 10:
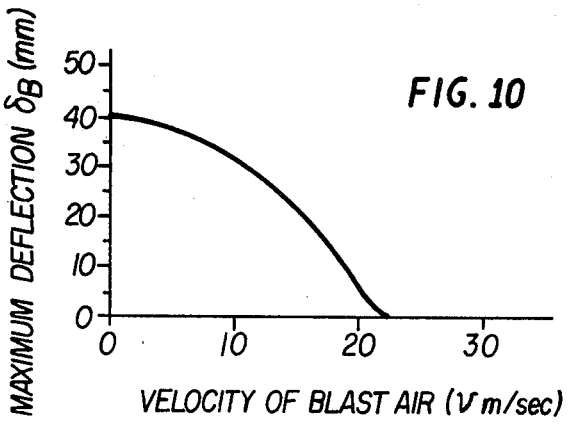
FIG. 10 is a graph illustrating influences of the velocity of blast air over the deformations of the loops.

The inclination angle α of each loop supported by the support conveyor 2 is very important for preventing the deformation of the loop. As shown in FIGS. 9(A) and (B), there are two types of deformations of a loop. Namely, FIG. 9(A) shows a deformation within the plane F of the loop (Strictly speaking, the loop is not in a plane since it is a part of a continuous coil. However, for the convenience sake, a loop is assumed to be flat.), while FIG. 9(B) illustrates deformation of the plane itself i.e. a deformation out of the plane F. It is usual, however, that both types of deformations are combined in a complex manner to result in an inferior appearence of the collected rod. It has been shown by these experiments that where each loop is supported at three points by the supporters 3 and the carriage conveyor 4 as shown in FIG. 1 and blast air is applied from below, the possibility of deformations both within the plane and out of the plane are effectively minimized if the inclination angle α is set at not greater than 60°. For instance, FIG. 10 shows the results of experiments wherein the relationship between the maximum deflection of a loop and the velocity v(m/sec.) of the blast air is determined where the temperature of the coiled rod was about 900° C., the temperature of the blast air supplied from below was 20° C., the diameter of the rod was 5.5 mmϕ, the diameter of a loop was 1100 mmϕ and the inclination angle α was 45°. The maximum deflection $\delta_B$ (mm) is illustrated in FIG. 9(II) wherein B is the position of the deflection and the symbol indicates the positions to be supported. It is seen from FIG. 10 that the maximum deflection ($\delta_B$) is as much as about 40 mm when no air is forcibly supplied, whereas the deflection becomes minimal at a velocity of the blast air of about 20 m/sec. or more, and the problem of inferior appearance of the collected rod is thus eliminated. Thus, it is possible to minimize deformations both within the loop plane and out of the loop plane to a negligible extent by forcibly supplying a cooling medium from below the coiled rod whereby the lifting power of the medium is utilized. It should be noted that the lifting power serves to compensate the weight of the loops themselves, thereby minimizing the possibility of deformations.

Thus, it is apparent that the setting of the inclination angle α at 30° to 60° and the forcible supply of the cooling medium from below the coiled rod serve not only to provide a uniform and adequate cooling but also to prevent deformations of the loops.

Further, in order to provide secure support for the loops during transportation, supporting protrusions, e.g. pins, may be provided on the carriage conveyors 4 and 5 at proper positions corresponding to the predetermined pitch P of the loops.

Now, examples of the aforementioned will be given.

EXAMPLE I

The controlled cooling according to the present invention was carried out with use of a steel rod having a diameter of 5.5 mmϕ and corresponding to JIS Standard SWRH 82 A (carbon content being 0.82 and manganese content being 0.45%) under the following conditions:

(1) Inclination angle α of the loops: 45°
(2) Pitch P of the loops: 30 mm
(3) Temperature of the rod immediately before the treatment: 900° C.
(4) Cooling medium: Air (at a temperature of 20° C.)

The treated coiled rod had a good appearance without any substantial deformations.

For the purpose of comparison, the same steel rod was subjected to controlled cooling by the conventional Stelmore line under the same conditions as indicated in the above conditions (3) and (4). In the Stelmore line, the loops are placed in a nonconcentrically overlapping manner in a flat form and therefore the inclination angle α of the loops in virtually zero. Further, the loops are in contact with the adjacent ones.

The tensile strengths obtained by the above treatments are shown in Table 1.

TABLE 1

| | Tensile Strength Average (kg/mm²) | Fluctuations in Tensile Strength per Coil (kg/mm²) | Fluctuations in Tensile Strength per Loop (kg/mm²) |
|---|---|---|---|
| Present Invention | 124.1 | 4.5 | 1.5 |
| Stelmore Line | 121.6 | 7.8 | 5.8 |

It is apparent from Table 1 that the coiled rod treated by the method of the present invention has less fluctuations in tensile strength per coil or per loop and a greater average tensile strength than the same rod treated by the Stelmore line under the same conditions. Thus, according to the present invention, it is possible to increase the cooling effectiveness of the cooling medium, thereby further improving the tensile strength without increasing the fluctuations in the tensile strength, whereas, in the Stelmore line, it is possible to increase the tensile strength by increasing the cooling effectiveness only at the risk of increasing the fluctuations in the tensile strength.

EXAMPLE II

A hot rolled steel rod having a diameter of 12 mmϕ and corresponding to JIS Standard SWRH 82B (carbon content being 0.83% and manganese content being 0.82) was treated by the method of the present invention with use of blast air as the cooling medium and, for the purpose of improving the tensile strength, with use of blast air with water mist, under the following conditions:

(1) Inclination angle α of the loops: 35°
(2) Pitch P of the loops: 90 mm
(3) Temperature of the rod immediately before the treatment: 900° C.
(4) Temperature of the cooling medium i.e. air and mist: 20° C.

The results of the treatments are shown in Table 2. This table also includes the comparative results obtained by the conventional Stelmore line and by the re-heating patenting in a lead bath i.e. lead patenting, for the purpose of comparison.

TABLE 2

| | | Tensile Strength Average (kg/mm²) | Fluctuations in Tensile Strength per Coil (kg/mm²) | Fluctuations in Tensile Strength per Loop (kg/mm²) |
|---|---|---|---|---|
| Present Invention | Blast Air with Mist | 130.5 | 5.0 | 2.0 |
| | Blast Air Only | 118.2 | 4.8 | 1.8 |
| Conventional Methods | Stelmore Line | 115.2 | 8.0 | 5.8 |
| | Lead Patenting | 131.2 | 4.5 | 1.5 |

Table 2 shows that where the rod is cooled by the blast air only, the tensile strength tends to decrease with an increase of the diameter of the rod. However, when compared with the conventional Stelmore Line, the method of the present invention still provides a remarkable improvement over the conventional method as also seen in Example 1. Namely, the rod treated by the method of the present invention has a high level of tensile strength and less fluctuations in tensile strength per coil or per loop. Further, a particular advantage of the present invention is seen when blast air with water mist is used as the cooling medium to improve the tensile strength. Namely, it is possible to obtain such a high level of tensile strength as never have been possible with the conventional Stelmore line, without increasing the fluctuations per coil or per loop. It is seen that the coiled rod treated by the method of the present invention with use of the blast air with mist compares with the same treated by the lead patenting in the level of the tensile strength and fluctuations in the tensile strength.

Thus, according to the present invention, it is possible to apply a uniform direct cooling along the entire loops of the coiled rod without creating deformations of the loops and without forming a super-cooled structure such as martensite and to produce a rod of a high tensile strength having an outstanding balance of strength and ductility which is superior to one obtainable by the conventional direct patenting. Since the rod of the present invention can have a higher strength than the rod treated by the conventional direct cooling, the total reduction of area in wire drawing may be reduced to attain a predetermined strength and accordingly the cost for the drawing may be reduced. Further, as the scale on the coil rod surface is decreased and becomes uniform, it is possible to shorten the time required for the pickling treatment. Thus, according to the present invention, it is possible to omit some treatment steps required for the lead patenting and to produce the final product simply by drawing the rod treated by the controlled cooling.

Further, in the controlled cooling treatment of the present invention, the coiled rod is supported immediately after it has been issued from the laying head, and therefore, even when there has been a change in the diameter of the coil to be treated, the operation can proceed in an orderly fashion without interruption. Thus, the method of the present invention is extremely advantageous in practical use.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlled cooling of a hot rolled steel rod, which comprises:

forming a hot rolled steel rod into a coil, transporting the coiled rod in a generally horizontal direction while supporting its loops at a loop plane angle of 30° to 60° relative to the direction of transportation and with a pitch of at least $2d/\sin\alpha$ in the direction of transportation, where d is a diameter of the coiled rod and $\alpha$ is the loop plane angle, and applying a cooling medium to the coiled rod upwardly from below the coiled rod during transportation to cool the coiled rod uniformly at such a cooling rate as to achieve a phase transformation and to obtain a structure consisting essentially of fine pearlite.

2. A method as claimed in claim 1, wherein the pitch of the loops are at least $4d/\sin\alpha$.

3. A method as claimed in claim 1 or 2, wherein the cooling medium comprises air and the air is applied to the coiled rod from below the coiled rod.

4. A method as claimed in claim 1 or 2, which further comprises applying the cooling medium to the coiled rod at a velocity of at least 20 m/sec.

5. An apparatus for controlled cooling of a hot rolled steel rod, which comprises:

a cooling device for rapidly cooling the hot rolled steel rod issued from a final stand of mill train, a laying head for forming the rapidly cooled rod into a coil, conveyor means for transporting the coiled rod in a generally horizontal direction while supporting its loops at a loop plane angle of 30° to 60° relative to the direction of transportation and with a pitch of at least $2d/\sin\alpha$ in the direction of transportation, where d is a diameter of the coiled rod and $\alpha$ is the loop plane angle, coolant means for applying a fluid cooling medium to the coiled rod upwardly from below the coiled rod during transportation to cool the coiled rod uniformly at such a cooling rate as to achieve a phase transformation and to obtain a structure consisting essentially of fine pearlite, and collecting means for collecting the coiled rod after the rod is issued from the conveyor means.

6. An apparatus as claimed in claim 5, the conveyor means comprising a carriage conveyor for carrying the coiled rod thereon and a support conveyor equipped with supporters for the loops of the coiled rod.

7. An apparatus as claimed in claim 5, the conveyor means comprising a first carriage conveyor for carrying the coiled rod issued from the laying head, a second carriage conveyor for carrying the coiled rod transferred from the first carriage conveyor and a support conveyor for supporting the loops of the coiled rod at said loop plane angle and with said pitch.

* * * * *

UNITED STATES PATENT AND TRADEMARK OFFICE

CERTIFICATE OF CORRECTION

PATENT NO. : 4,362,040

DATED : December 7, 1982

INVENTOR(S) : YOSHIHIRO YAMAGUCHI ET AL

It is certified that error appears in the above—identified patent and that said Letters Patent is hereby corrected as shown below:

In the Abstract, line 17, after "pitch," insert therefor --a control mechanism for synchronizing the speeds of the laying head and conveyor,--;

In column 1, line 32, delete "Publications" and insert therefor --Publication--;

In column 2, line 66, delete "diagramatic" and insert therefor --diagrammatic--;

In column 3, line 1, delete "diagramatic" and insert therefor --diagrammatic--;

In column 3, line 3, delete "diagramatic" and insert therefor --diagrammatic--;

UNITED STATES PATENT AND TRADEMARK OFFICE

CERTIFICATE OF CORRECTION

PATENT NO. : 4,362,040

DATED : December 7, 1982

INVENTOR(S) : YOSHIHIRO YAMAGUCHI ET AL

It is certified that error appears in the above-identified patent and that said Letters Patent is hereby corrected as shown below:

In column 4, line 39, delete "(FIG. 5(II))" and insert therefor --FIG. 5(B)--;

In column 4, line 59, delete "θ" and insert therefor --θ'--;

In column 5, line 47, delete "second" and insert therefor --seconds--;

In column 7, line 14, delete "appearence" and insert therefor --appearance--;

In column 7, line 30, delete "FIG. 9(II)" and insert therefor --FIG. 9(B)--;

In column 7, line 31, after "symbol" insert therefor --Δ--.

Signed and Sealed this

Twentieth Day of September 1983

[SEAL]

Attest:

GERALD J. MOSSINGHOFF

Attesting Officer

Commissioner of Patents and Trademarks